United States Patent [19]

Eheim

[11] Patent Number: 4,478,188

[45] Date of Patent: Oct. 23, 1984

[54] ADJUSTABLE HYDRAULICALLY OPERATED STOP

[75] Inventor: Franz Eheim, Stuttgart, Fed. Rep. of Germany

[73] Assignee: Robert Bosch GmbH, Stuttgart, Fed. Rep. of Germany

[21] Appl. No.: 362,373

[22] Filed: Mar. 26, 1982

[30] Foreign Application Priority Data

Mar. 26, 1981 [DE] Fed. Rep. of Germany ..... 3111944

[51] Int. Cl.[3] ..... F02M 41/00

[52] U.S. Cl. ..... 123/450; 123/446; 123/385

[58] Field of Search ..... 123/504, 450, 385, 446, 123/447

[56] References Cited

U.S. PATENT DOCUMENTS

| | | | |
|---|---|---|---|
| 3,500,749 | 3/1970 | Kemp | 123/450 |
| 3,506,381 | 4/1970 | Kemp | 123/450 |
| 4,232,644 | 11/1980 | Potter | 123/450 |
| 4,278,058 | 7/1981 | Berner | 123/385 |
| 4,364,360 | 12/1982 | Eheim | 123/450 |

*Primary Examiner*—Charles J. Myhre
*Assistant Examiner*—Carl Stuart Miller
*Attorney, Agent, or Firm*—Edwin E. Greigg

[57] ABSTRACT

An adjustable hydraulically operated stop for pulsed loading is proposed, which is particularly applicable for the metering piston of a fuel injection system. The stroke of this metering piston can be varied by adjusting a stop body by means of a metering converter. The supply chamber communicating with a fuel source or with the pump work chamber of one of the pump/nozzles of the fuel injection system, whose size is dependent on the stroke of the metering piston, determines the injected fuel quantity. The adjustable hydraulically operated stop encompasses a mechanical stop body, which is movably supported with respect to its adjusting member embodied by a sheath and communicates therewith via fluid, which also surrounds the adjusting member. The adjusting forces for the adjusting member are kept small, and the holding forces required to prevent a change in the position assumed by the adjusting member are kept equal to zero, because pressure fluctuations affecting the fluid are cancelled out with respect to the adjusting member. To this end, the adjusting member is received in its entirety within a fluid-filled chamber. A spring acting upon the stop body assures the constant renewal of the hydraulic cushion in the case of pulsed operation.

12 Claims, 3 Drawing Figures

ADJUSTABLE HYDRAULICALLY OPERATED STOP

BACKGROUND OF THE INVENTION

The invention is based on an adjustable hydraulically operated stop. In known hydraulic stops of this kind, the mechanical adjustment member has to accommodate relatively high stop loads. As a result, the adjusting forces required to adjust the stop are also relatively great. A further disadvantage in hydraulic stops of this kind is that leakage losses occur, particularly in the case of pulsed loading.

OBJECT AND SUMMARY OF THE INVENTION

The hydraulically operated stop according to the invention has the advantage over the prior art that the position of the respective stop plunger can be varied using extremely small adjusting forces, and the selected position can be maintained precisely without stressing the adjusting means, despite the load exerted on the stop plunger. This hydraulically operated stop has the further advantage that the hydraulic cushion is renewed following each load pulse. Changes in the position of the stop plunger caused by leakage losses are thus avoided. Because the adjusting member is in a fluid bath, pressure fluctuations affecting the hydraulic fluid are thus equalized with respect to the adjustment member, so that its position remains unaffected. Especially when the hydraulically operated stop is used in fuel injection systems, it is particularly advantageous that the adjustment member is embodied in the form of a sheath, which offers a multiplicity of opportunities for control by means of a metering converter.

The invention will be better understood and further objects and advantages thereof will become more apparent from the ensuing detailed description of three preferred embodiments taken in conjunction with the drawings.

DESCRIPTION OF THE PREFERRED EMBODIMENTS

Figure 1:
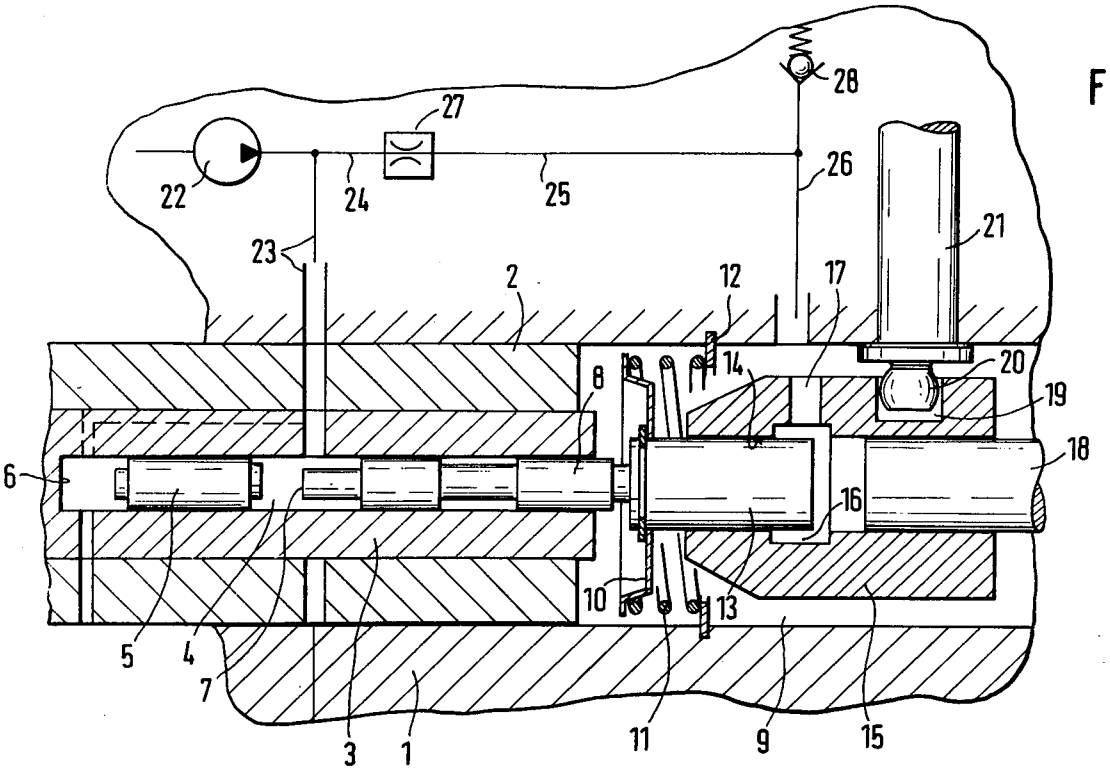
FIG. 1 shows a schematic detail of a fuel injection system, having a hydraulically operated stop according to the invention in a first form of embodiment.

A control sleeve 2 is supported within a housing 1. The control sleeve 2 receives a rotatable distributor 3. This distributor 3, in turn, is provided with a central bore 4 in which a metering piston 5 is supported in an axially movable manner. The supply chamber for this metering piston 5 is formed by the central bore 4 of the distributor 3, by the metering piston 5 and by the end stop 6 and stop plunger 7 which determine the total stroke length of this metering piston 5. The stop plunger 7 is embodied by a piston-like stop body 8, which engages the central bore 4 in a sealing manner. The stop body 8 protrudes out from the distributor 3 into a chamber 9 which is formed by the housing 1. Inside this chamber 9, the stop body 8 carries a cup-like disc 10, which holds one end of a helical spring 11 supported on its other end by a snap ring 12. The snap ring 12 is set into a corresponding annular groove in the housing 1, inside the chamber 9. The free, piston-like end 13 of the stop body 8 engages the sheath bore 14 of a sheath 15. A chamber-like enlargement 16 into which an opening 17 in the wall of the sheath 15 discharges is located inside the sheath bore 14. The end 13 of the stop body 8 protrudes far enough to reach into the enlargement 16. From the end of the sheath 15 located opposite the stop body 8, a rod-like means 18 attached to the housing 1 engages the sheath bore 14. The sheath 15 rests on this rod-like means 18 such that it is displaceable in the direction of its longitudinal axis. A crank protuberance 20 of an adjusting shaft 21 extends into a recess 19 of the sheath 15. The rotary position of the adjusting shaft 21 is determined by a metering converter, not shown in FIGS. 1 and 2. A fuel line 23 leads from a fuel source 22 to the supply chamber of the central bore 4 of the distributor 3 via bores associated with this fuel line 23 and located in the control sleeve 2 and the distributor 3. Additionally, the fuel source 22 is connected with the chamber 9 via fuel lines 24, 25 and 26 and a throttle 27. In this manner, the chamber 9 is filled with fuel. A compensating valve is indicated by reference numeral 28.

Figure 2:
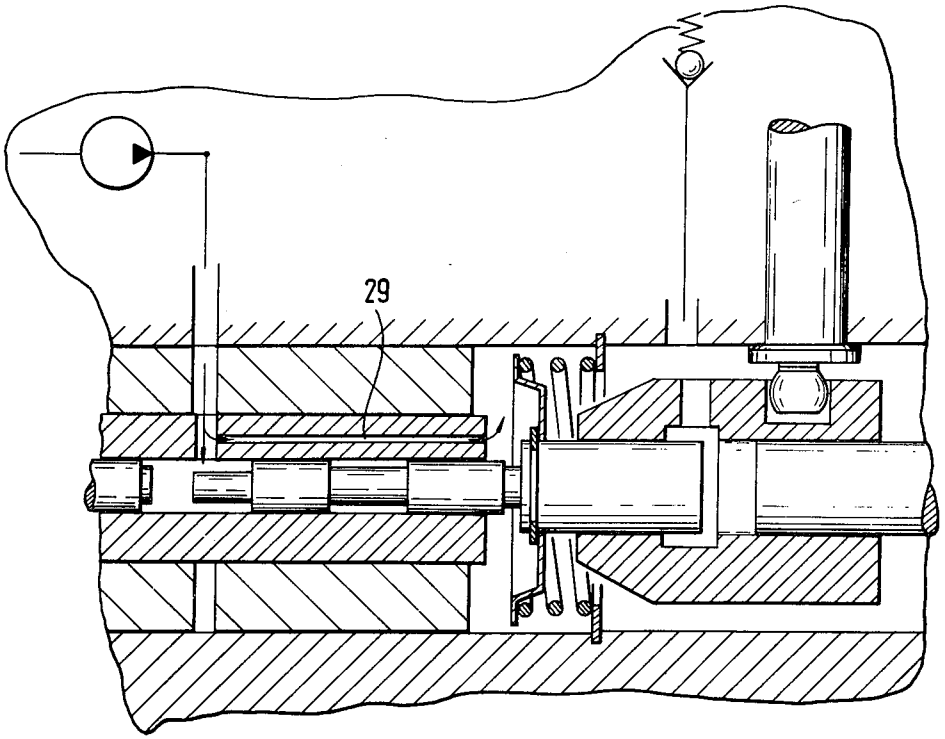
FIG. 2 is another schematic detail comparable to FIG. 1, showing a hydraulically operated stop according to the invention in a second form of embodiment.

The spring 11 always tends to keep the stop body 8 in its stop position on the distributor 3. As soon as fuel from the fuel source 22 enters the supply chamber of the central bore 4 in the distributor 3, the stop body 8 is positively displaced toward the right, as seen in FIGS. 1 and 2, counter to the force of the spring 11, until its end 13 tends to leave the enlargement 16 and enter the portion of the sheath bore 14 in which the rod-like means 18 is located. The fluid cushion between the rod-like means 18 and the end face of the end 13 now acts as the hydraulically operated stop for the stop body 8. The total stroke length of the metering piston 5 is thus fixed. Upon each occasion where the stop body 8 is briefly relieved, this body is retracted by means of its spring 11 out of the hydraulic stop position, and when there is renewed pressure from the fuel source 22 it seeks to resume this stop position. The rotary position of the adjusting shaft 21 is determined by a metering converter, which evaluates engine data such as rpm and load in order to determine the injection quantity. The crank protuberance 20 engaging the recess 19 of the sheath 15 adjusts the sheath 15 on the rod-like means 18 in accordance therewith. The rim of the enlargement 16 oriented toward the rod-like means 18 thereupon changes its position, and the stop position for the stop body 8 changes in a corresponding manner. Thus there is a variation in the supply chamber for the metering piston 5.

In the exemplary embodiment of FIG. 2, the additional connection of the fuel source 22 with the chamber 9 is established by means of at least one longitudinal bore 29 in the distributor 3. Otherwise, this exemplary embodiment is substantially identical to that of FIG. 1.

Figure 3:
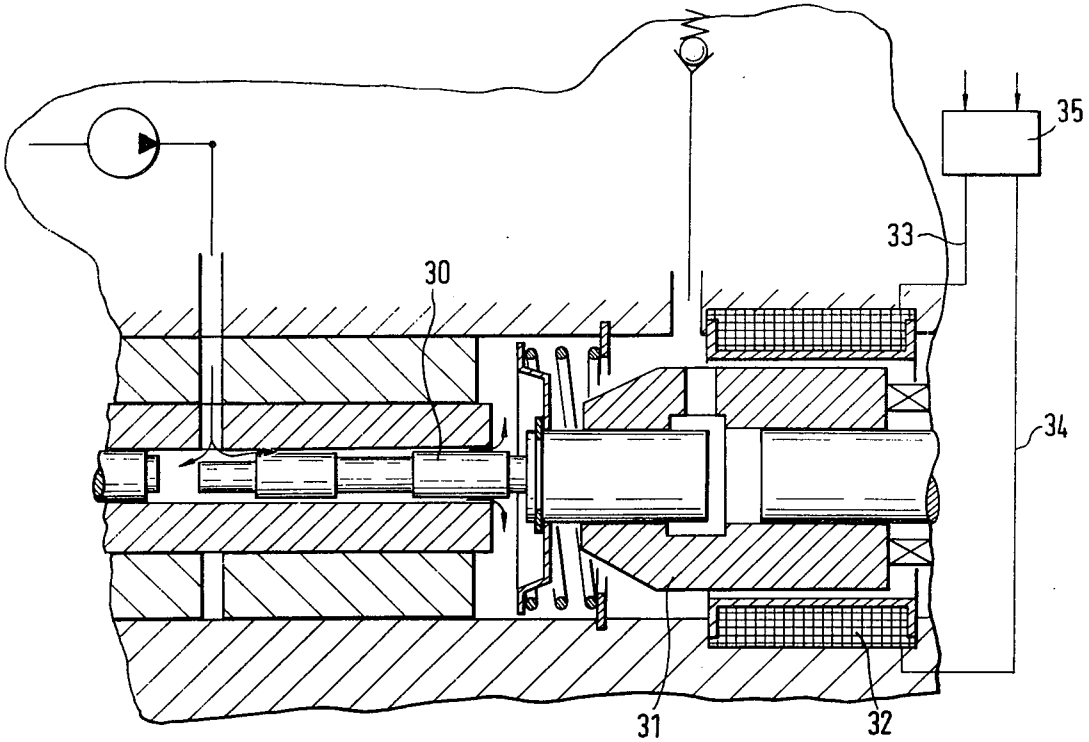
FIG. 3 is still another schematic detail comparable to FIG. 1, showing a hydraulically operated stop according to the invention in a third form of embodiment.

In the exemplary embodiment of FIG. 3, the additional connection of the fuel source 22 with the chamber 9 is accomplished by means of the play of a stop plunger 30 in the central bore 4 of the distributor 3. Instead of the sheath 15, a sheath 31 is used which except for the recess 19 is substantially identical to the sheath 15. In contrast to the sheath 15, the sheath 31 forms the immersion core of an electromagnetic immersion coil 32, which is connected with a metering converter 35 via electric lines 33 and 34. This metering converter 35 determines the position of the sheath 31 on the rod-like means 18 by means of the appropriate control of the immersion core 32, and thus also determines the position of the hydraulic stop for the stop plunger 30.

In all three exemplary embodiments, the force components of the fluid pressure exerted on the surface of the sheath 15 or 31 cancel one another out. The position of the sheath and thus the position of the hydraulic stop can thus be varied with very small forces. Practically zero forces are required for maintaining the selected position of the sheath.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An adjustable hydraulically operated stop comprising a housing for pulsed loading, in particular for a metering piston of a fuel metering apparatus, said metering apparatus provided with a supply chamber of said piston wherein said hydraulic stop encompasses a stop body which is movably supported in a distributor and arranged to determine the stroke length of the metering piston associated therewith, said stop body also being movably supported with respect to an adjusting member and subjected to a hydraulic fluid in which said hydraulic fluid also surrounds said adjusting member, such that pressure fluctuations acting upon the hydraulic fluid are cancelled out with respect to said adjusting member, whereby the position thereof is unaffected, said adjusting member for said stop body being a sheath provided with a sheath wall and a bore having a chamber-like enlargement, an opening in said sheath wall arranged to discharge into said bore, said sheath further being displaceably guided in an adjusting direction on a rod-like means attached to said housing and engaging said bore, said rod-like means arranged to protrude as far as said chamber-like enlargement, said sheath further arranged to cooperate with a stop body slidably arranged relative to said sheath whereby said stop body sealingly engages said sheath bore and protrudes into said chamber-like enlargement.

2. An adjustable hydraulically operated stop as defined by claim 1, characterized in that said position of said sheath is determined mechanically by a metering converter.

3. An adjustable hydraulically operated stop as defined by claim 1, characterized in that said position of said sheath is determined electromechanically by a metering converter.

4. An adjustable hydraulically operated stop as defined by claim 1, characterized in that said position of said sheath is determined electromagnetically by a metering converter.

5. An adjustable hydraulically operated stop as defined by claim 1, characterized in that said position of said sheath is determined mechanically-hydraulically by a metering converter.

6. An adjustable hydraulically operated stop device as defined by claim 1, characterized in that said stop body is connected with a restoring spring which forces said stop body out of said sheath, and that said sheath is adjustable relative to said housing by means interconnecting said sheath therewith and whereas a chamber filled with fluid surrounds portions of said stop body and said sheath.

7. An adjustable hydraulically operated stop with a housing as defined by claim 1, characterized in that said sheath has a recess arranged to be engaged by a crank means of an adjusting shaft, whose rotary positional adjustment is effected by means of a metering converter.

8. An adjustable hydraulically operated stop as defined by claim 6, characterized in that, at least a portion of said chamber arranged to receive an electromagnetic immersion coil and in which said sheath functions as an immersion core, said core further having a position which is controlled by a metering converter.

9. An adjustable hydraulically operated stop as defined by claim 8, characterized in that said chamber surrounding said sheath is connected via a fuel line with said fuel source whereby fuel is forced into the supply chamber of the metering piston via an additional connecting line.

10. An adjustable hydraulically operated stop as defined by claim 9, characterized in that said additional connecting line is provided with a throttle.

11. An adjustable hydraulically operated stop as defined by claim 9, characterized in that said additional connecting line is disposed in said distributor.

12. An adjustable hydraulically operated stop as defined by claim 9, characterized in that said distributor has a central bore and said stop body has a circumference lesser than said bore, thereby providing said additional connecting line.

* * * * *